US012110790B2

(12) United States Patent
Jacques et al.

(10) Patent No.: US 12,110,790 B2
(45) Date of Patent: Oct. 8, 2024

(54) METHOD AND SYSTEM FOR ESTIMATING A DEPTH PRESSURE AND/OR PERMEABILITY PROFILE OF A GEOLOGICAL FORMATION HAVING A WELL

(71) Applicant: TotalEnergies OneTech, Courbevoie (FR)

(72) Inventors: Antoine Jacques, Pau (FR); Benoit Brouard, Pau (FR); Vincent Jaffrezic, Pau (FR)

(73) Assignee: TotalEnergies OneTech, Courbevoie (FR)

( * ) Notice: Subject to any disclaimer, the term of this patent is extended or adjusted under 35 U.S.C. 154(b) by 0 days.

(21) Appl. No.: 18/256,194

(22) PCT Filed: Dec. 16, 2020

(86) PCT No.: PCT/IB2020/001113

§ 371 (c)(1),
(2) Date: Jun. 6, 2023

(87) PCT Pub. No.: WO2022/129978

PCT Pub. Date: Jun. 23, 2022

(65) Prior Publication Data

US 2024/0018867 A1 Jan. 18, 2024

(51) Int. Cl.
*E21B 49/00* (2006.01)
*E21B 47/04* (2012.01)

(52) U.S. Cl.
CPC ..... *E21B 49/008* (2013.01)

(58) Field of Classification Search
CPC ..... E21B 49/008; E21B 49/006; E21B 47/04; E21B 47/047; E21B 47/10
(Continued)

(56) References Cited

U.S. PATENT DOCUMENTS 2,524,933 A * 10/1950 Silverman ..... E21B 47/047 73/304 R
8,583,378 B2 11/2013 Jacques et al.
2023/0175392 A1* 6/2023 Jacques ..... E21B 47/06 73/152.29

FOREIGN PATENT DOCUMENTS

EP 2 120 068 A1 11/2009

OTHER PUBLICATIONS

Manivannan, S., "Measuring permeability vs depth in the unlined section of a wellbore using the descent of a fluid column made of two distinct fluids: inversion workflow, laboratory & in-situ tests" HAL archives-ouvertes, Jan. 2019, 151 pages.
(Continued)

*Primary Examiner* — Kenneth L Thompson
(74) *Attorney, Agent, or Firm* — Seed IP Law Group LLP

(57) ABSTRACT

A method for estimating a depth pressure and/or permeability profile of a geological formation having a well extending between a first end and a second end includes equipping the well with an inner tube defining an inner space and an annular space; performing a first well closing phase by injecting a second fluid having a higher viscosity than a first fluid in the well while extracting under a first constant pressure value; performing a second well closing phase by injecting the second fluid while extracting the first fluid under a second constant pressure value, different from the first constant pressure value; and estimating the depth pressure and/or permeability profile of the geological formation based on measurements performed during the first well closing phase and the second well closing phase.

16 Claims, 5 Drawing Sheets

(58) Field of Classification Search
USPC ..... 73/152.29, 152.05, 152.41
See application file for complete search history.

(56) References Cited

OTHER PUBLICATIONS

Jacques, A. et al., "Let's Combine Well Testing and Logging: a Pre and Post Frac Shale Gas Field Case", Unconventional Resources Technology Conference URTec: 127, Jul. 2019, 20 pages.
Manivannan, S. et al., "Permeability Logging through Constant Pressure Injection Test: In-Situ Methodology and Laboratory Tests", Society of Petroleum Engineers, Sep. 2019, 23 pages.
International Search Report for International Application No. PCT/IB2020/00113, mailing date Sep. 17, 2021, 3 pages.

* cited by examiner

METHOD AND SYSTEM FOR ESTIMATING A DEPTH PRESSURE AND/OR PERMEABILITY PROFILE OF A GEOLOGICAL FORMATION HAVING A WELL

BACKGROUND

Technical Field

This disclosure relates to the field of geological formations studies, and relates more particularly to a method and system for estimating the depth pressure and/or permeability profile of a geological formation having a well, e.g., such as a well to be used for recovering hydrocarbons (oil, natural gas, shale gas, etc.) from said geological formation.

Description of the Related Art

A well used for reaching a geological formation usually extends between a first end located towards the surface level, or "wellhead," and a second end opposed to the first end.

Immediately after drilling, a well consists in a borehole in the geological formation, with at most the first end cased, the cased portion being usually referred to as "shoe" of the well, the rest of the well not being cased and being usually referred to as "borehole" portion of the well. Such a configuration is usually referred to as "open-hole" configuration.

After it has been drilled, and before considering incurring the costs of casing the well, the well undergoes well testing operations in order to determine if this well will be used for hydrocarbon recovery or abandoned as a dry hole.

If the well testing operations determine that the well may be used for hydrocarbon recovery, then it is cased, from the first end to the second end, in order to, e.g., prevent it from closing upon itself.

Well testing operations usually use tools that are inserted into the well in order to measure and evaluate physical properties of the geological formation along the length of the borehole portion of the well.

In particular, the depth pressure profile and depth permeability profile of the geological formation are of interest.

The depth pressure profile of the geological formation corresponds to the variation of the pressure of the geological formation (a.k.a. the natural pressure or pore pressure) along the length of the borehole portion of the well, i.e., the pressure of each layer of the geological formation passed through by the borehole portion of the well. Similarly, the depth permeability profile corresponds to the variation of the permeability of the geological formation along the length of the borehole portion of the well.

For instance, document EP 2120068 A1 describes a solution for well testing operations. In document EP 2120068 A1, a tube is inserted down to the second end of the well. The tube defines two spaces inside the well: an inner space inside the tube, and an annular space surrounding the tube, between the outer surface of the tube and the inner surface of the well. The inner space and the annular space are in fluidic communication towards the second end of the well. Then the well is filled with two fluids and an interface between the two fluids is moved in the annular space, by injecting a second fluid in the inner space at the first end of the well, and by extracting a first fluid from the annular space at the first end, and vice versa. Hence, the fluids are circulated inside the well, from the first end to the second end via the inner space and from the second end to the first end via the annular space, and vice versa. By disturbing the hydraulic balance of the fluids inside the well, and by measuring effects of said disturbance of the hydraulic balance, the solution proposed enables to estimate physical properties of the borehole portion of the well. These estimated physical properties may be used to determine whether the well should be cased or not.

A drawback of the solution described by document EP 2120068 A1 lies in the fact that it can be computationally demanding in some cases, because there are many different physical properties that need to be determined. Many computer simulations need to be performed in order to find an optimum set of values for the physical properties that is consistent with the measurements.

BRIEF SUMMARY

The present disclosure aims at improving the situation. In particular, the present disclosure aims at overcoming at least some of the limitations of the prior art discussed above, by proposing a solution for estimating a depth pressure and/or permeability profile of a geological formation that reduces the computational complexity while maintaining accuracy.

According to a first aspect, the present disclosure relates to a method for estimating a depth pressure and/or permeability profile of a geological formation, a well extending in the geological formation between a first end and a second end, said method comprising equipping the well with an inner tube extending between the first end of the well and towards the second end of the well, said tube defining an inner space and an annular space in fluid communication towards the second end of the well, wherein said method further comprises:

- the annular space of the well being filled with a first fluid: performing a first well closing phase by injecting, into the inner space at the first end of the well, a second fluid having a higher viscosity than the first fluid while extracting, from the annular space at the first end of the well, the first fluid under a first constant pressure value in the annular space at the first end of the well, wherein the first well closing phase comprises measuring a first temporal injection flowrate profile of the second fluid, a first temporal extraction flowrate profile of the first fluid, and a first temporal pressure profile in the inner space at the first end of the well;
- the annular space of the well being filled with the first fluid: performing a second well closing phase by injecting, into the inner space at the first end of the well, the second fluid while extracting, from the annular space at the first end of the well, the first fluid under a second constant pressure value in the annular space at the first end of the well, the second constant pressure value being different from the first constant pressure value, wherein the second well closing phase comprises measuring a second temporal injection flowrate profile of the second fluid, a second temporal extraction flowrate profile of the first fluid, and a second temporal pressure profile in the inner space at the first end of the well;
- estimating the depth pressure and/or permeability profile of the geological formation based on the measurements performed during the first well closing phase and the second well closing phase.

Hence, the estimating method uses an inner tube that is inserted in the well, as in document EP 2120068 A1.

Then the estimating method performs at least two well closing phases. A well closing phase corresponds to a phase during which the well, initially filled with a first fluid at least in a bottom portion of the annular space, is progressively filled with a second fluid having a higher viscosity than the first fluid, the second fluid being injected in the inner space at the first end of the well while the first fluid is extracted from the annular space at the first end of the well. Each well closing phase is performed while maintaining the pressure substantially constant in the annular space at the first end of the well, and the estimating method uses different constant pressure values for the at least two well closing phases. Each well closing phase uses the same first and second fluids, i.e., the first fluid used has the same physical properties (density, viscosity, compressibility) during both well closing phases and the second fluid used has also the same physical properties during both well closing phases.

During each well closing phase, the injection flowrate, the extraction flowrate and the pressure in the inner space at the first end of the well are measured continuously. Hence, the estimating method may rely only on measurements performed at the wellhead, without requiring inserting sensors at the bottom of the well.

Thanks to the fact that at least two well closing phases are performed under substantially the same conditions (same fluids used) except for the constant pressure value maintained in the annular space at the first end of the well, the measurements made can be used to estimate the depth pressure and/or permeability profile of the geological formation in the bottom portion of the well. Indeed, for each layer of the geological formation, the measurements may be used to derive a non-linear system having substantially two equations for two unknowns, which can be solved with a reduced computational complexity with respect to the prior art.

In specific embodiments, the estimating method can further comprise one or more of the following features, considered either alone or in any technically possible combination.

In specific embodiments, the geological formation is decomposed in a plurality of layers, and estimating the depth pressure and/or permeability profile comprises, for each of the first well closing phase and the second well closing phase:

- determining a temporal evolution of the position in the well of the interface between the first fluid and the second fluid;
- determining a variation of injectivity for each layer;
- determining a temporal evolution of a pressure in the well along the layers of the geological formation;
- determining a reference well pressure value for each layer of the geological formation based on the temporal evolution of the well pressure along the layers;
- and a pressure value and/or a permeability value of the geological formation is determined for each layer of the geological formation, based on the injectivity variation and on the well pressure value of each layer of the geological formation, thereby obtaining the depth pressure and/or permeability profile of the geological formation.

In specific embodiments, the first constant pressure value $P_1$ and the second constant pressure value $P_2$ are such that:

$$\max(P_1,P_2)/\min(P_1,P_2)>\alpha$$

wherein $\alpha$ is higher than or equal to 1.2, or higher than or equal to 1.5.

In specific embodiments, the first fluid has the same density as the second fluid.

In specific embodiments, the second fluid is a gel and/or the first fluid is water or brine.

In specific embodiments, the estimating method comprises performing at least a third well closing phase under a third constant pressure value in the annular space at the first end of the well, said third constant pressure value being different from the first and second constant pressure values, and the depth pressure and/or permeability profile of the geological formation is estimated based on the measurements performed during the first, second and third well closing phases.

According to a second aspect, the present disclosure relates to a computer program product comprising code instructions which, when executed by a processor, cause said processor to carry out the step, of the estimating method according to any one of the embodiments of the present disclosure, whereby the depth pressure and/or permeability profile of the geological formation is estimated based on the measurements performed during at least the first well closing phase and the second well closing phase.

According to a third aspect, the present disclosure relates to a computer-readable storage medium comprising code instructions which, when executed by a processor, cause said processor to carry out the step, of the estimating method according to any one of the embodiments of the present disclosure, whereby the depth pressure and/or permeability profile of the geological formation is estimated based on the measurements performed during at least the first well closing phase and the second well closing phase.

According to a fourth aspect, the present disclosure relates to a system for estimating a depth pressure and/or permeability profile of a geological formation, a well extending in the geological formation between a first end and a second end, said well being equipped with an inner tube extending between the first end of the well and towards the second end of the well, said tube defining an inner space and an annular space in fluid communication towards the second end of the well, wherein the system comprises means configured for implementing an estimating method according to any one of the embodiments of the present disclosure.

In specific embodiments, the well comprises a cased portion at the first end and a borehole portion towards the second end.

BRIEF DESCRIPTION OF THE SEVERAL VIEWS OF THE DRAWINGS

The present disclosure will be better understood upon reading the following description, given as an example that is in no way limiting, and made in reference to the figures which show.

In these figures, references identical from one figure to another designate identical or analogous elements. For reasons of clarity, the elements shown are not to scale, unless explicitly stated otherwise.

DETAILED DESCRIPTION

As discussed above, the present disclosure relates inter alia to a method and system for estimating a depth pressure and/or permeability profile of a geological formation having a well 10.

The present disclosure relates more specifically to well testing operations, for measuring and evaluating physical properties of the geological formation in order to determine, e.g., whether the well 10 can be used for hydrocarbon recovery. Hence, the present disclosure finds a main and preferred application in case of well 10 having an open-hole configuration.

However, the present disclosure may also be applied to other configurations, including a well having a cased-hole configuration.

Also, the present disclosure is not limited to a specific geometric configuration for the well 10, and can be applied to wells comprising vertical, slanted or horizontal portions, or any combination thereof (provided that a tube 21 may be inserted inside the well 10)

In the following description, the case of a vertical well 10 having an open-hole configuration is considered, as a non-limitative example.

Figure 1:
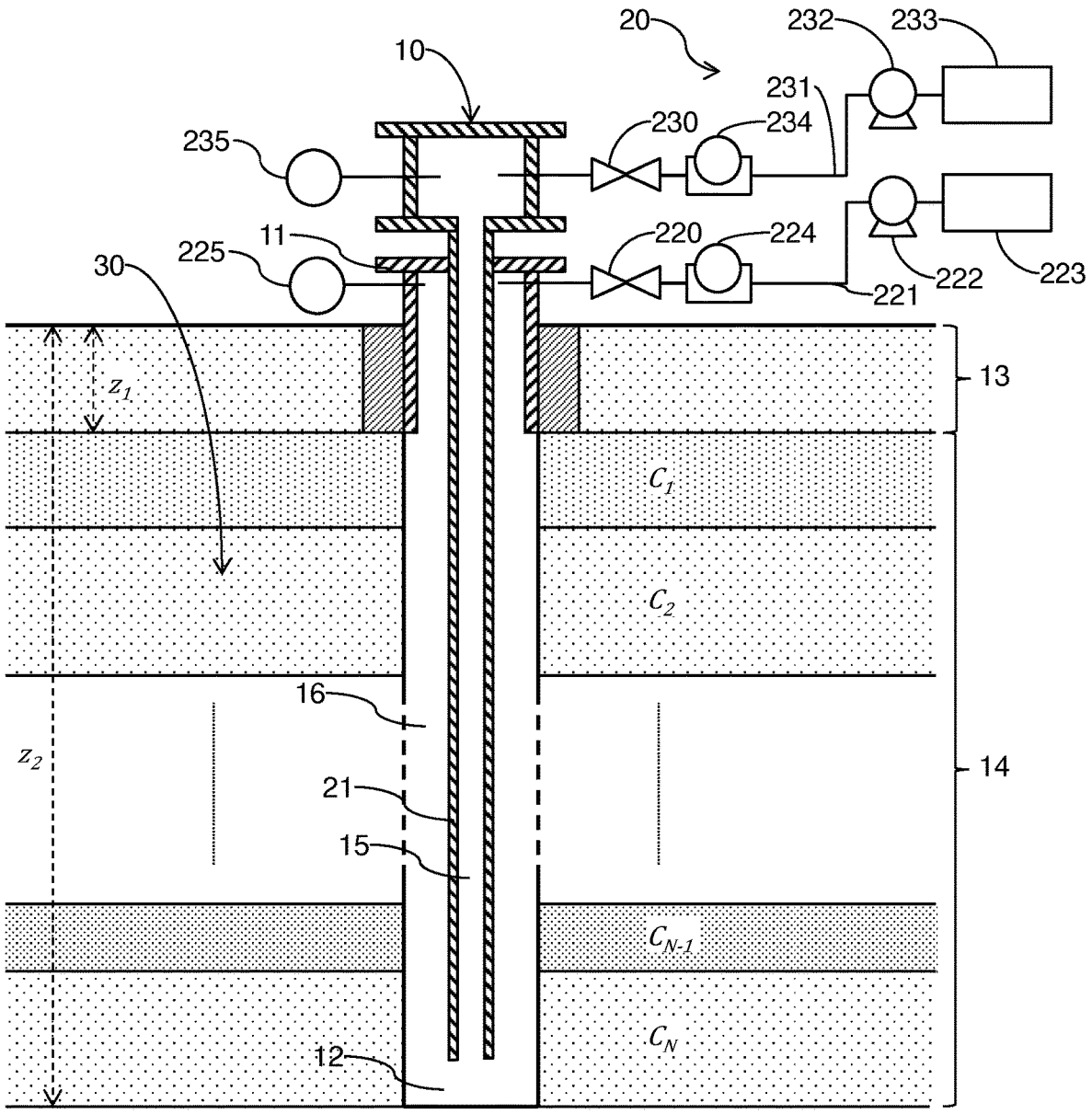
FIG. 1 depicts a schematic representation of a cross-sectional view of a well passing through a geological formation.

FIG. 1 represents schematically a cross-sectional view of a well 10 made in a geological formation 30 for which a depth pressure and/or permeability profile is to be estimated.

As illustrated by FIG. 1, the well 10 extends between a first end 11 located towards the surface level (or "wellhead"), and a second end 12, opposed to the first end 11 and located underground (or "well bottom").

As illustrated by FIG. 1, a cemented casing, which may comprise an internal metal cylinder, forms the internal lining of a cased portion 13 of the well 10 towards the first end 11. This cased portion 13 is also referred to as "shoe" of the well 10. This cased portion 13 is substantially seal-tight to the various fluids that can circulate in the well 10. The bottom of the cased portion 13 is situated at a depth $z_1$.

In the present disclosure, the depth of a given point along the well 10 corresponds to the length measured along the well 10 between said given point of the well 10 and a reference point of the well 10, for instance located towards the surface level. For instance, the reference point may be the first end 11 of the well 10. The depth considered herein is sometimes referred to as measured depth or MD in the literature. Hence, in the present disclosure, the depth injection flowrate profile to be estimated is a function of the depth (MD) measured along the well 10. In most cases (e.g., if the well 10 is not completely vertical), the depth (MD) of a given point of the well 10 is different from the actual depth of this given point, which corresponds to the distance measured vertically between the surface level (or the sea level) and said given point of the well 10. This actual depth is sometimes referred to as true vertical depth or TVD in the literature.

Under the cased portion 13, the well 10 comprises a borehole portion 14 which extends from the bottom of the cased portion 13 to the second end 12 of the well 10. In this borehole portion 14, the internal surface of the well 10 consists in the geological formation 30 itself. In the example illustrated by FIG. 1, the borehole portion 14 passes through a succession of N geological layers denoted $C_1, C_2, \ldots, C_N$. These geological layers are made of materials that are substantially homogeneous in their mineralogical composition. The first geological layer $C_1$ is situated under the cased portion 13 and adjacent to the latter. The geological layer $C_N$ is situated close to the second end 12. These geological layers $C_1$-$C_N$ of materials are represented as horizontal around the well 10, but they can of course be arranged otherwise.

Each geological layer $C_n$ ($1 \leq n \leq N$) is delimited by a top surface and a bottom surface. The bottom surface of a geological layer $C_n$ corresponds to the top surface of the next geological layer $C_{n+1}$. The bottom surface of the last geological layer $C_N$ can be considered to be situated at the second end 12 of the well 10, which is situated at a depth $z_2$ (MD).

The respective depths (MD) of the surfaces between the geological layers $C_1$-$C_N$ may have been determined by known subsoil imaging techniques, notably by seismic techniques implemented before the drilling of the well 10 or by diagraphic techniques implemented during the drilling of the well 10. These techniques make it possible to be informed of the geometry of the geological layers $C_1$-$C_N$ forming the subsoil.

Each geological layer $C_n$ can be characterized by physical properties such as a permeability, a porosity or a pressure (sometimes referred to as natural pressure or pore pressure). The present disclosure aims at determining at least one among the pressure and the permeability for each geological layer $C_n$ ($1 \leq n \leq N$) but may also be used to estimate other physical properties.

By estimating the "depth pressure profile" of the geological formation 30, we mean estimating the pressure for each geological layer $C_n$ ($1 \leq n \leq N$) in the borehole portion 14 of the well 10, each geological layer having a predetermined thickness associated thereto. Similarly, by estimating the "depth permeability profile" of the geological formation 30, we mean estimating the permeability for each geological layer $C_n$ ($1 \leq n \leq N$) in the borehole portion of the well 10.

It is also emphasized that the present disclosure may also be applied by considering arbitrary layers in the borehole portion 14 of the well 10 instead of geological layers $C_n$ ($1 \leq n \leq N$). For instance, it is possible to consider successive layers having a same predefined thickness along the well 10, from the bottom of the cased portion 13 to the second end 12 of the well 10, without requiring any knowledge on the actual configuration of the geological layers $C_n$. In such a case, the estimated depth pressure and permeability profiles may be used to identify the adjacent layers having substantially the same physical properties and which can be considered to belong to a same geological layer.

FIG. 1 shows also components of a system 20 for estimating the depth pressure and/or permeability profile of the geological formation 30 in the borehole portion 14 of the well 10.

As can be seen in FIG. 1, the system 20 for estimating the depth pressure and/or permeability profile comprises a tube 21 inserted in the well 10, extending from the first end 11 of the well 10 to substantially the second end 12 of the well 10. This tube 21 defines two different spaces inside the well 10:

- an inner space 15 inside the tube 21; and
- an annular space 16 defined between the external surface of the tube 21 and the internal surface of the well 10 (i.e., the casing in the cased portion 13 and the geological formation itself in the borehole portion 14).

The inner space 15 and the annular space 16 are in fluid communication towards the second end 12 of the well 10, such that a fluid moving downwards in the inner space 15 may arrive at the second end 12 of the well 10 where it can be injected into the annular space 16 and move upwards to the first end 11 of the well 10, and vice-versa.

The system 20 for estimating the depth pressure and/or permeability profile comprises means for injecting fluids in the tube 21 at the first end 11 of the well 10 and means for extracting fluids from the annular space 16 at the first end 11 of the well 10. The system 20 comprises also means for measuring and controlling continuously, at the first end 11 of the well 10:

the injection flowrate in the inner space 15;

the extraction flowrate from the annular space 16;

the pressure in the inner space 15; and the pressure in the annular space 16.

In the non-limitative example illustrated by FIG. 1, the extracting means comprise a valve 220, a line 221 and a pump 222 with a tank 223 adapted for containing a first fluid 22 extracted from the annular space 16 at the first end 11 of the well 10. Similarly, the injecting means comprise a valve 230, a line 231 and a pump 232 with a tank 233 adapted for containing a second fluid 23 to be injected in the inner space 15 at the first end 11 of the well 10.

In the example illustrated by FIG. 1, the measuring means comprise a flowmeter 224 in the line 221, for measuring the extraction flowrate of the first fluid 22 from the annular space 16 of the well 10, and a pressure sensor 225 for measuring the pressure in the annular space 16 at the first end 11 of the well 10. The measuring means comprise also a flowmeter 234 in the line 231, for measuring the injection flowrate of the second fluid 23 in the inner space 15 of the well 10, and a pressure sensor 235 for measuring the pressure in the inner space 15 at the first end 11 of the well 10.

It should be noted that the injecting, extracting and measuring means illustrated in FIG. 1 correspond to a non-limitative exemplary configuration. It is emphasized that other configurations may be used, as long as they enable:

injecting a fluid in the inner space 15 at the first end 11 of the well 10, while measuring and controlling the injection flowrate and the pressure in the inner space 15 at the first end 11 of the well 10;

extracting a fluid from the annular space 16 at the first end 11 of the well 10, while measuring and controlling the extraction flowrate and the pressure in the annular space 16 at the first end 11 of the well 10.

In particular, and as will be discussed below, the injecting, extracting and measuring means need to enable continuously injecting a second fluid 23 in the inner space 15 and simultaneously extracting a first fluid 22 from the annular space 16, while maintaining a constant pressure value in the annular space 16 at the first end 11 of the well 10.

The estimating system 20 comprises also means for estimating the depth pressure and/or permeability profile of the geological formation 30 in the borehole portion of the well 10 based on the measurements performed by the measuring means.

These estimating means (not represented in the figures) correspond for instance to a processing circuit comprising one or more processors and storage means (magnetic hard disk, solid-state disk, optical disk, or any type of computer-readable storage medium) in which a computer program product is stored, in the form of a set of program-code instructions to be executed in order to estimate the depth pressure and/or permeability profile. Alternatively, or in combination thereof, the processing circuit can comprise one or more programmable logic circuits (FPGA, PLD, etc.), and/or one or more specialized integrated circuits (ASIC), and/or a set of discrete electronic components, etc., adapted for implementing all or part of the operations for estimating the depth pressure and/or permeability profile of the geological formation 30.

Figure 2:
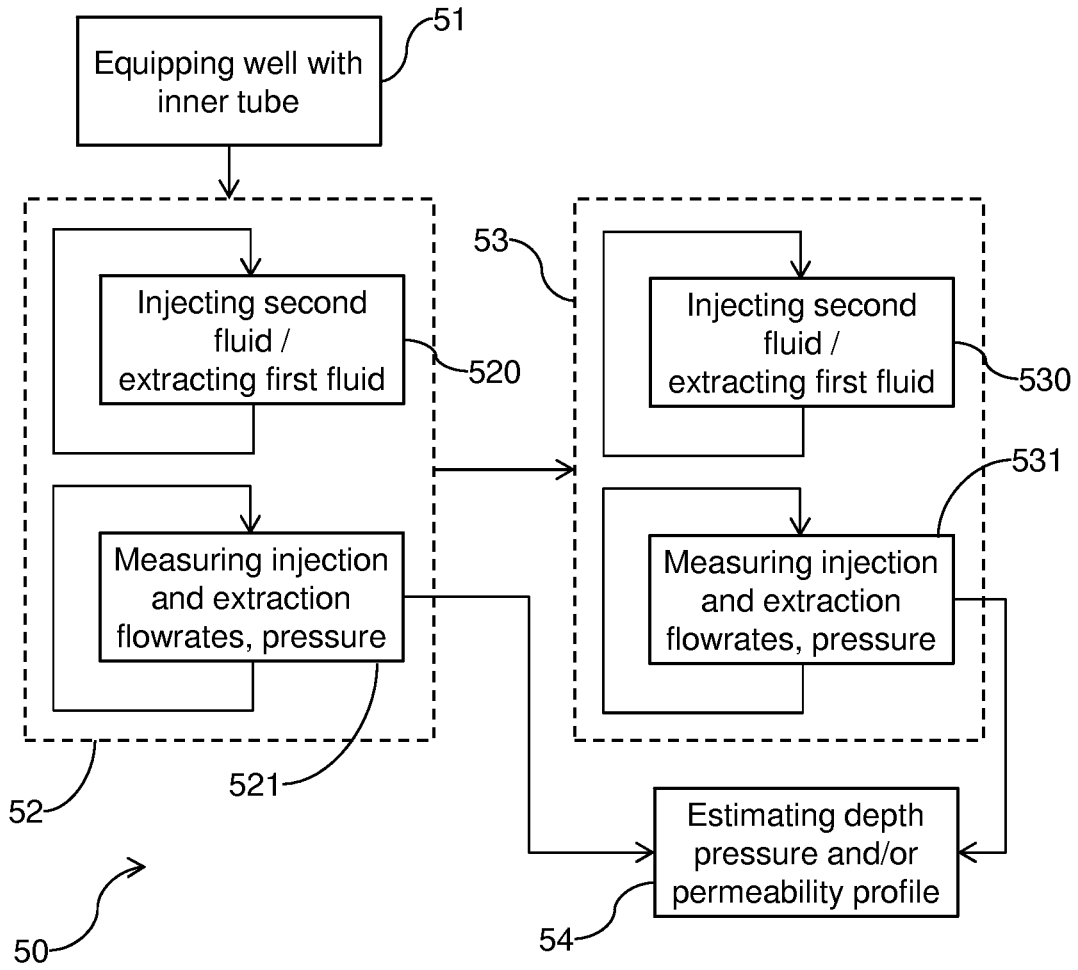
FIG. 2 depicts a flow chart illustrating the main steps of a method for estimating a depth pressure and/or permeability profile of a geological formation.

FIG. 2 represents a flow chart illustrating the main steps of a method 50 for estimating a depth pressure and/or permeability profile of the geological formation in the borehole portion 14 of the well 10.

As illustrated by FIG. 2, the estimating method 50 comprises first a step 51 of equipping the well 10 with the tube 21, as represented in FIG. 1.

As illustrated by FIG. 2, the estimating method 50 comprises two main phases during which fluids are circulated inside the well 10. These main phases are referred to as "well closing phases."

The estimating method 50 comprises a step 52 of performing a first well closing phase which may start when the well 10, or at least the annular space 16 in the borehole portion 14 thereof, is filled with a first fluid 22.

The step 52 of performing the first well closing phase comprises a step 520 of injecting a second fluid 23 into the inner space 15 at the first end 11 of the well 10, while extracting the first fluid from the annular space 16 at the first end 11 of the well 10. The second fluid 23 is injected continuously into the well 10 until the well 10 is filled with said second fluid 23, or at least the annular space 16 in the borehole portion 14 of the well 10.

The injection/extraction is performed while maintaining the pressure constant in the annular space 16 at the first end 11 of the well 10, equal to a first constant pressure value $P_1$, for the duration of the first well closing phase, or at least for the duration required to fill the annular space 16 in the borehole portion 14 of the well 10 with the second fluid 23. The second fluid 23 has a higher viscosity than the first fluid 22, thereby resulting in a "closing" of the borehole portion 14 of the well 10.

For instance, the first fluid 22 is a non-viscous fluid such as water and/or brine, and the second fluid 23 is a viscous fluid such as a gel. For instance, the viscosity of the first fluid 22 is lower than 2 centipoises (cP, one cP being equal to one millipascal-second—mPa·s), and the viscosity of the second fluid 23 is higher than 30 cP. Preferably, the ratio between the viscosity of the second fluid 23 and the viscosity of the first fluid 22 is equal to or higher than thirty (30), for instance around fifty (50). Preferably, the first fluid 22 and the second fluid 23 have the same density, in order to, e.g., stabilize the interface 24 between the second fluid 23 and the first fluid 22. However, it is emphasized that the second fluid 23 is not necessarily viscous, and the first fluid 22 and the second fluid 23 need only to have contrasted viscosities and to be immiscible.

The step 52 of performing the first well closing phase comprises also a step 521 of measuring continuously:

the pressure in the inner space 15 at the first end 11, thereby obtaining a first temporal pressure profile $P_{in}^1(t)$;

the injection flowrate in the inner space 15 at the first end 11, thereby obtaining a first temporal injection flowrate profile $Q_{in}^1(t)$;

the extraction flowrate from the annular space 16 at the first end 11, thereby obtaining a first temporal extraction flowrate profile $Q_{out}^1(t)$; and the pressure in the annular space 16 at the first end 11, for controlling that it remains equal to the first constant pressure value $P_1$.

The estimating method 50 comprises also a step 53 of performing a second well closing phase which may start when the well 10, or at least the annular space 16 in the borehole portion 14 thereof, is filled with the first fluid 22.

Of course, although not represented, this implies that a well opening phase is performed between both well closing phases, in order to re-fill the well 10 with the first fluid 22, or at least the annular space 16 in the borehole portion 14 thereof. This may be accomplished, for instance, by injecting the first fluid 22 in the inner space 15 at the first end 11, or by circulating the fluids in the other direction, i.e., by injecting the first fluid 22 in the annular space 16 at the first end 11 while extracting the second fluid 23 from the inner space 15 at the first end 11.

The step 53 of performing the second well closing phase comprises a step 530 of injecting the second fluid 23 into the inner space 15 at the first end 11 of the well 10, while extracting the first fluid 22 from the annular space 16 at the first end 11 of the well 10. The second fluid 23 is injected continuously into the well 10 until the well 10 is filled with said second fluid 23, or at least the annular space 16 in the borehole portion 14 of the well 10.

The injection/extraction is performed while maintaining the pressure constant in the annular space 16 at the first end 11 of the well 10, equal to a second constant pressure value $P_2$, for the duration of the first well closing phase, or at least for the duration required to fill the annular space 16 in the borehole portion 14 of the well 10 with the second fluid 23. The second constant pressure value $P_2$ is different from the first constant pressure value $P_1$, and preferably significantly different. For instance, the first constant pressure value $P_1$ and the second constant pressure value $P_2$ are such that:

$$\max(P_1,P_2)/\min(P_1,P_2)>\alpha$$

wherein $\alpha$ is higher than or equal to 1.2, or higher than or equal to 1.5, or preferably higher than or equal to 2.

The step 53 of performing the second well closing phase comprises also a step 531 of measuring continuously:

- the pressure in the inner space 15 at the first end 11, thereby obtaining a second temporal pressure profile $P_{in}^2(t)$;
- the injection flowrate in the inner space 15 at the first end 11, thereby obtaining a second temporal injection flowrate profile $Q_{in}^2(t)$;
- the extraction flowrate from the annular space 16 at the first end 11, thereby obtaining a second temporal extraction flowrate profile $Q_{out}^2(t)$; and
- the pressure in the annular space 16 at the first end 11, for controlling that it remains equal to the second constant pressure value $P_2$.

As illustrated by FIG. 2, the estimating method 50 then comprises a step 54 of estimating the depth pressure and/or permeability profile of the geological formation 30 in the borehole portion 14 of the well 10 based on the measurements performed during the first well closing phase and the second well closing phase, i.e., the first and second temporal injection flowrates profiles, the first and second temporal extraction flowrate profiles and the first and second temporal pressure profiles. The first and second constant pressure values $P_1$ and $P_2$ are also used during step 54.

Figure 3:
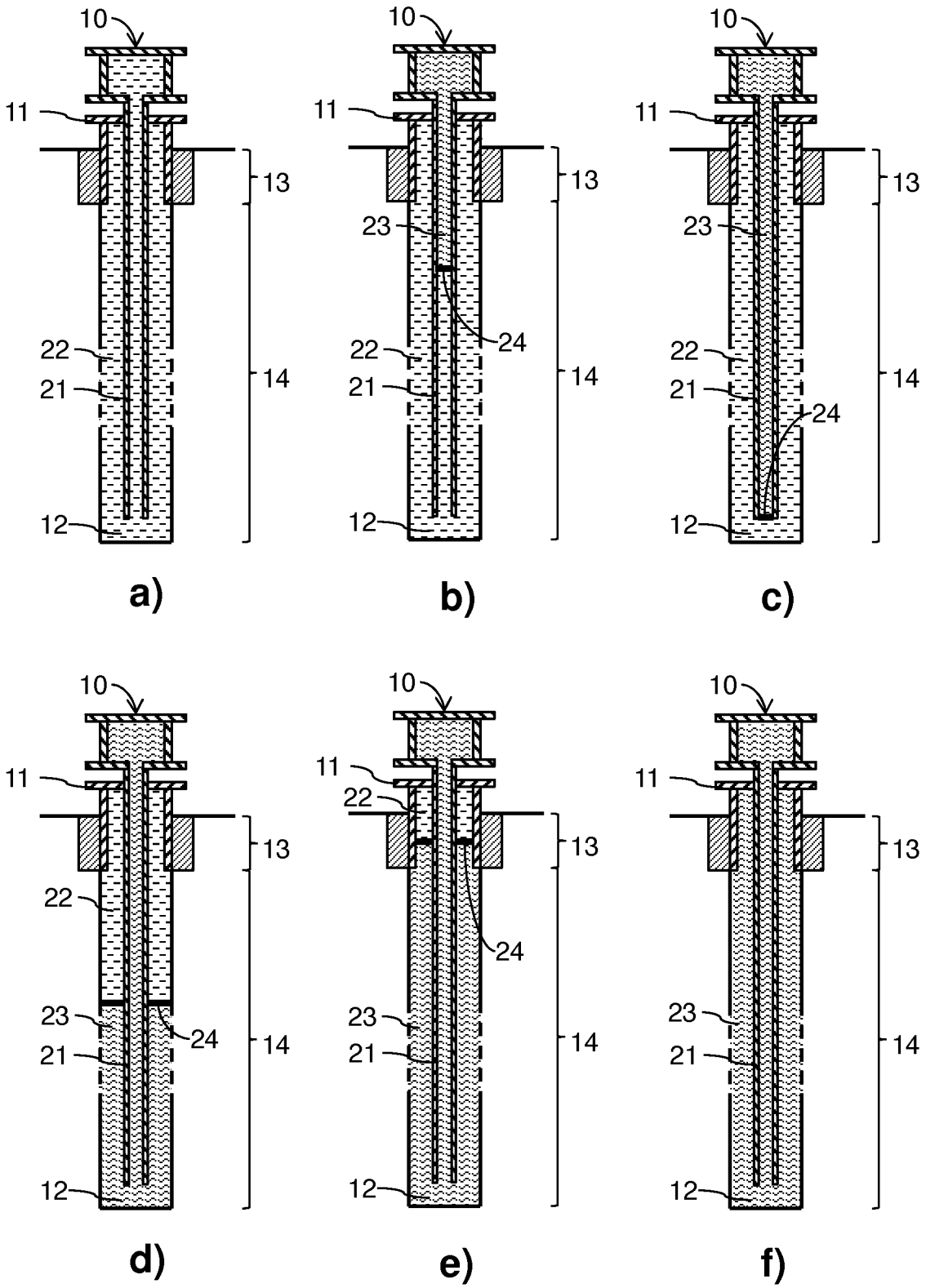
FIG. 3 depicts schematic representations of cross-sectional views of the well during a well closing phase of the estimating method.

FIG. 3 represents schematically cross-sectional views of the well 10 during a well closing phase.

In part a) of FIG. 3, the well 10 is assumed to be initially completely filled with the first fluid 22. In part b) of FIG. 3, the injection of the second fluid 23 in the inner space 15 at the first end 11 has started, and the first fluid 22 is extracted from the annular space 16 at the first end 11 while maintaining a constant pressure value ($P_1$ or $P_2$) in the annular space 16 at the first end 11. The second fluid 23 and the first fluid 22 have different viscosities and are immiscible, such that an interface 24 between the second fluid 23 and the first fluid 22 appears inside the inner space 15 of the well 10. The interface 24 travels downwards inside the tube 21 from the first end 11 of the well towards the second end 12 as the second fluid 23 is injected into the inner space 15 of the well 10. In part c) of FIG. 3, the interface 24 has reached the second end 12. The tube 21 is completely filled with the second fluid 23. In part d) of FIG. 3, the interface 24 travels upwards in the annular space 16 of the well 10, in the borehole portion 14 of the well 10. This corresponds to the actual "closing" of the well 10, since the borehole portion 14 of the well 10 is the only portion where fluids can penetrate into the geological formation 30, and since the second fluid 23 has a higher viscosity than the first fluid 22 and is therefore less likely to penetrate into the geological formation. In part e) of FIG. 3, the interface 24 has continued to move upwards such that the annular space 16 in the borehole portion 14 of the well 10 is completely filled with the second fluid 23. In part f) of FIG. 3, the interface 24 has continued to move upwards and both the inner space 15 and the annular space 16 of the well 10 are completely filled with the second fluid 23.

Figure 4:
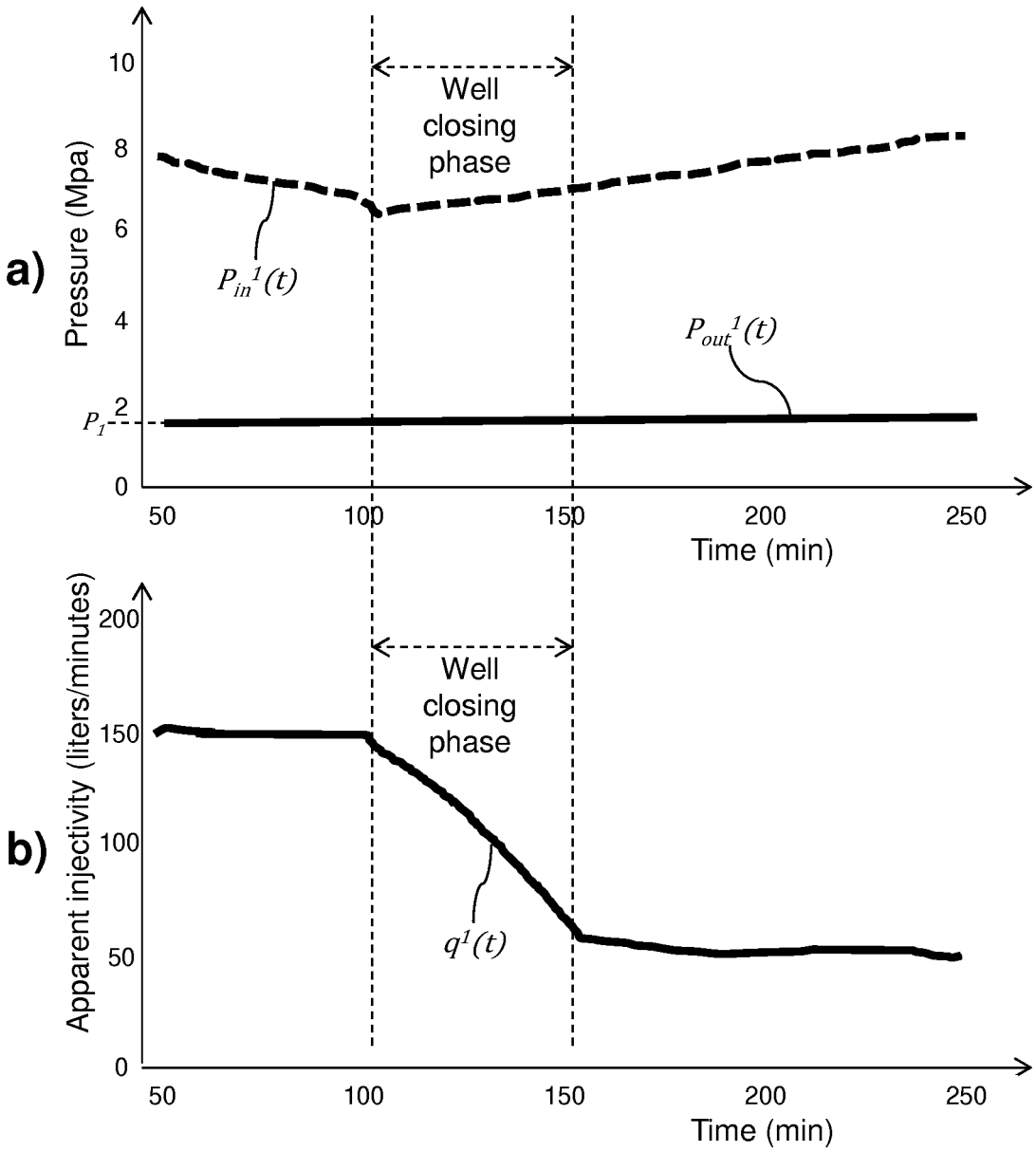
FIG. 4 depicts graphs illustrating examples of the pressures and of the apparent injectivity obtained during a well closing phase.

FIG. 4 represents schematically examples of the temporal evolution of the pressures and of the apparent injectivity (see below) obtained for the first well closing phase. More specifically, part a) of FIG. 4 represents the temporal evolution of the pressure $P_{in}^1(t)$ in the inner space 15 at the first end 11 and of the pressure $P_{out}^1(t)$ in the annular space 16 at the first end 11, and part b) of FIG. 4 represents the temporal evolution of the apparent injectivity $q^1(t)$. As can be seen in part a) of FIG. 4, the pressure $P_{out}^1(t)$ remains substantially equal to the first constant pressure value $P_1$ during all the time interval considered. In turn, the pressure $P_{in}^1(t)$ tends to decrease slightly before the first well closing phase, and then increases during the first well closing phase, especially when the second fluid 23 reaches the borehole portion 14 of the well 10, due the higher viscosity of the second fluid 23. As can be seen in part b) of FIG. 4, the apparent injectivity $q^1(t)$ is substantially constant before the first well closing phase, and then decreases during the first well closing phase, especially when the second fluid 23 reaches the borehole portion 14 of the well 10, due the higher viscosity of the second fluid 23.

Figure 5:
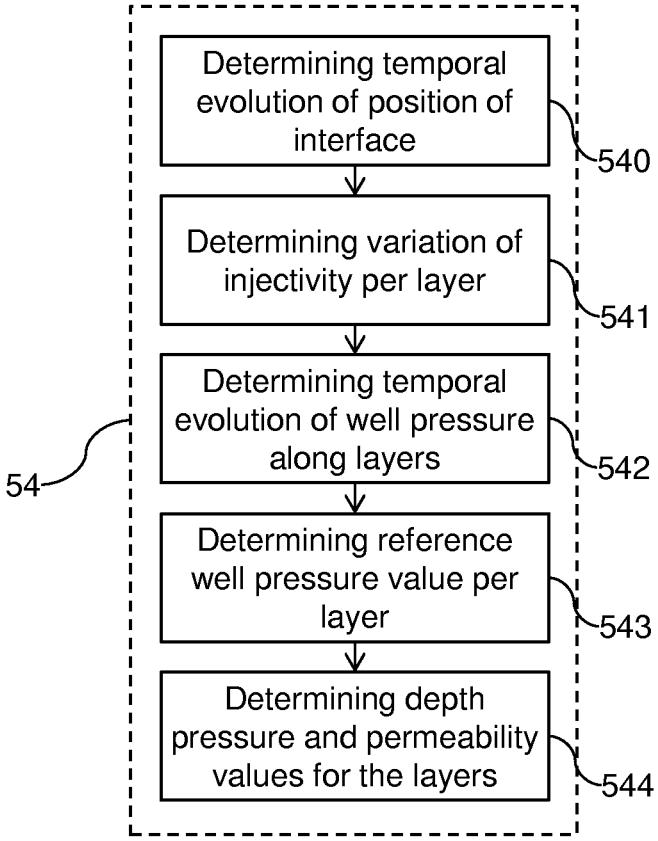
FIG. 5 depicts a flow chart illustrating the main steps of a preferred embodiment of an estimating step of the estimating method.

FIG. 5 represents schematically the main steps of a preferred embodiment of the estimating step 54 of the estimating method 50.

As illustrated by FIG. 5, the estimating step 54 comprises, for each of the first well closing phase and the second well closing phase:

- a step 540 of determining a temporal evolution of the position in the well 10 of the interface 24 between the first fluid 22 and the second fluid 23;
- a step 541 of determining a variation of injectivity for each geological layer $C_n$;
- a step 542 of determining a temporal evolution of a pressure in the well 10 along the geological layers $C_n$ of the geological formation 30; and
- a step 543 of determining a reference well pressure value for each geological layer $C_n$ of the geological formation 30 based on the temporal evolution of the well pressure along the geological layers $C_n$.

Then the estimating step 54 comprises a step 544 of determining a pressure value and/or a permeability value for each geological layer $C_n$ of the geological formation 30, based on the injectivity variation and on the reference well pressure value in the well 10 for each geological layer $C_n$ thereby obtaining the depth pressure and/or permeability profile of the geological formation 30 in the borehole portion 14 of the well 10.

During step 540, the temporal evolution of the position in the well 10 of the interface 24 between the first fluid 22 and the second fluid 23 is determined. The position of the interface 24 is denoted by $x^j(t)$, wherein the j=1 for the first well closing phase and j=2 for the second well closing phase. It should be noted that the position $x^j(t)$ takes into account the presence of the tube 21 inside the well 10, and the fact that the interface 24 travels first in the inner space 15 and second in the annular space 16 of the well 10. Hence the position $x^j(t)$ is for instance measured from the first end 11 of the well 10, in the inner space 15, to the first end 11 of the well 10, in the annular space 16, over a length that is substantially twice the actual length of the well 10. Basically, the position $x^j(t)$ makes it possible to determine whether the interface 24 is in the inner space 15 or in the annular space 16, and more specifically whether the interface 24 is in the annular space 16 of the borehole portion 14 of the well 10.

If the permeability of the geological formation 30 is low and if the second fluid 23 has a high viscosity, then the position $x^j(t)$ may be estimated based on the following equation:

$$\int_0^t Q_{in}^j(\tau)d\tau = \int_0^t \Sigma(\tau)v^j(\tau)d\tau$$

wherein:

$$v^j(t) = \frac{d}{dt}\left[x^j(t)\right] \text{ is the speed of the interface 24;}$$

$\Sigma(t)$ is the area of the cross-section of the well 10 (either in the inner space 15 of in the annular space 16) at the level of the interface 24, which may be assumed to be known.

If the injectivity of the second fluid 23 into the geological formation 30 cannot be neglected, then the following equation may be used:

$$\Sigma(t) \times v^j(t) = \frac{\chi l_1(t)Q_{in}^j(t) + l_2(t)Q_{out}^j(t)}{\chi l_1(t) + l_2(t)}$$

wherein:

$l_2(t)$ and $l_1(t)$ correspond to the lengths, in the annular space 16 of the borehole portion 14 of the well 10, covered by respectively the second fluid 23 and the first fluid 22;

$\chi$ corresponds to the ratio between an apparent injectivity (see below) when the annular space 16 in the borehole portion 14 is completely filled with the first fluid 22 and the apparent injectivity when the annular space 16 in the borehole portion 14 is completely filled with the second fluid 23.

At each instant, the apparent injectivity $q^j(t)$ may be computed by using the following equation:

$$q^j(t)=Q_{in}^j(t)-Q_{out}^j(t)$$

Preferably, the apparent injectivity $q^j(t)$ may be instead computed by using the following equation:

$$q^j(t) = \frac{d}{dt}\left[V_{in}^j(t) - V_{out}^j(t)\right]$$

wherein:

$$V_{in}^j(t) = \int_0^t Q_{in}^j(\tau)d\tau$$

$$V_{out}^j(t) = \int_0^t Q_{out}^j(\tau)d\tau$$

If we denote by $q_{max}^j$ the maximum apparent injectivity (i.e., when the annular space 16 in the borehole portion 14 is filled with the first fluid 22) and by $q_{min}^j$ the minimum apparent injectivity (i.e., when the annular space 16 in the borehole portion 14 is filled with the second fluid 23), then $\chi=q_{max}^j/q_{min}^j$ (in principle $\chi$ is the same for both the first and second well closing phases).

Hence, the above equations may be used to determine the temporal evolution of the position $x^j(t)$ of the interface 24 and the apparent injectivity $q^j(t)$ as a function of $x^j(t)$ during both the first well closing phase and the second well closing phase.

Figure 6:
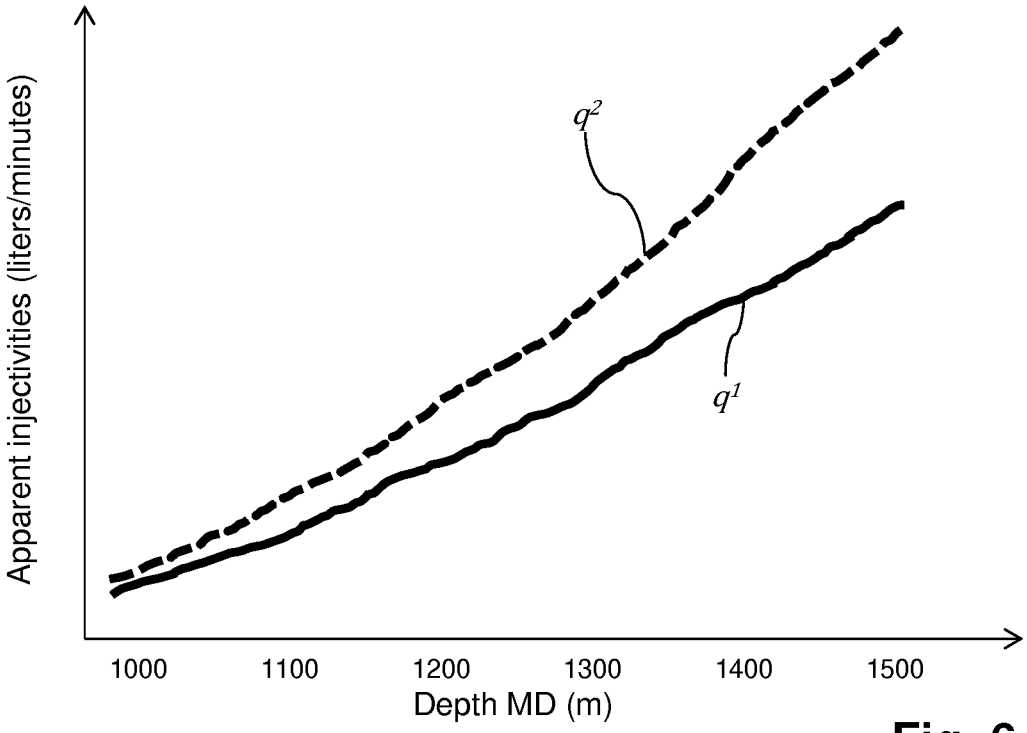
FIG. 6 depicts graphs illustrating apparent injectivity profiles obtained for different well closing phases of the estimating method.

For illustration purposes, FIG. 6 represents a graph illustrating an example of apparent injectivities determined for different positions of the interface 24 during a first well closing phase and a second closing phase. In this example, the borehole portion 14 of the well 10 is located between a depth $z_1$ (MD) of 1000 meters and a depth $z_2$ (MD) of 1500 meters. As can be seen in FIG. 6, the apparent injectivity $q^j(t)$ decreases as the interface 24 moves upwards (from the depth $z_2$ to the depth $z_1$). Also, the second constant pressure value $P_2$ is assumed to be higher than the first constant pressure value $P_1$, such that the apparent injectivity $q^2(t)$ is higher than the apparent injectivity $q^1(t)$.

During step 541, the variation of injectivity is determined for each geological layer $C_n$.

At this stage, it is recalled that it is also possible, in other embodiments, to consider arbitrary layers instead of geological layers, such as layers having all the same predefined thickness along the borehole portion 14 of the well 10.

The variation of injectivity may be determined based on the temporal injection flowrate profile of the second fluid 23, on the temporal extraction flowrate profile of the first fluid 22 and on the temporal evolution of the position in the well 10 of the interface 24.

For instance, given the thickness e n and depth for each geological layer $C_n$ ($1 \le n \le N$), it is possible to use the temporal evolution of the position $x^j(t)$ to determine an input time $t_{in}^{n,j}$ and an output time $t_{out}^{n,j}$, which correspond respectively to the time when the interface 24 has entered the geological layer $C_n$ during the well closing phase of index j (i.e., first or second well closing phase) and to the time when the interface 24 has exited said geological layer $C_n$ during said well closing phase of index j. The input time $t_{in}^{n,j}$ and the output time $t_{out}^{n,j}$ are such that $e_n=|x^j(t_{out}^{n,j})\ x^j(t_{in}^{n,j})|$.

Then the variation of injectivity $\Delta q^{n,j}$, for the geological layer $C_n$ and the well closing phase of index j, may be computed based on the apparent injectivity q' (t) (which may be computed based on $Q_{in}^j(t)$ and $Q_{out}^j(t)$ as discussed above), for instance by using the following equation;

$$\Delta q^{n,j}=q^j(t_{out}^{n,j})-q^j(t_{in}^{n,j})$$

It is emphasized that the variation of injectivity $\Delta q^{n,j}$ relates mainly to the injectivity of the first fluid 22, since the injectivity of the second fluid 23, due to its higher viscosity, is lower than that of the first fluid 22.

During step 542, the temporal evolution of the pressure in the annular space 16 of the well at least along the borehole portion 14, is determined. In other words, this step 542 aims at determining the pressure in the well 10 in a plurality of positions in the annular space 16 in the borehole portion 14, and their variations over time, denoted $P_{well}^{j}(x,t)$, wherein:

- the positions x considered are preferably those in the annular space 16 of the well 10, in the borehole portion 14 at least; and
- the times t considered are preferably at least those between $t_{in}^{1,j}$ and $t_{out}^{N,j}$.

For instance, the well pressure $P_{well}^{j}(x,t)$ may be computed by determining the pressure losses inside the well 10, and their variations over time.

The pressure losses may be computed, e.g., by using the well-known Darcy-Weisbach equation, and depends on the considered position inside the well 10, on the characteristics of the well 10 at the considered position (e.g., dimensions and shape, e.g., disk in the inner space 15 or ring in the annular space 16—of the cross section at the considered position), of the physical properties of the fluids (e.g., viscosity and density) and their types (Newtonian or non-Newtonian), on the current position of the interface 24, on the flowrate at the considered position (which may be obtained based on the measured injection and extraction flowrates), etc.

Then, the well pressure $P_{well}^{j}(x,t)$ may be computed by using the computed pressure losses and the constant pressure value $P_j$ in the annular space 16 at the first end 11 of the well 10.

During step 543, a reference well pressure value $P_{well}^{n,j}$ is determined for each geological layer $C_n$ of the geological formation 30, based on the well pressure $P_{well}^{j}(x,t)$, in particular the well pressure values obtained for $x \in [x^j(t_{in}^{n,j}), x^j(t_{out}^{n,j})]$ and for $t \in [t_{in}^{n,j}, t_{out}^{n,j}]$. For instance, the reference well pressure value $P_{well}^{n,j}$ may be computed as a mean value of the well pressure $P_{well}^{j}(x,t)$ over the time interval $[t_{in}^{n,j}, t_{out}^{n,j}]$ over the positions $[x^j(t_{in}^{n,j}), x^j(t_{out}^{n,j})]$. However, the reference well pressure value $P_{well}^{n,j}$ may be computed differently.

Then the estimating step 54 comprises the step 544 of determining a pressure value and/or a permeability value for each geological layer $C_n$ of the geological formation 30, based on the injectivity variations $\Delta q^{n,j}$ and on the reference well pressure values $P_{well}^{n,j}$ obtained for each geological layer $C_n$ and for the first and second well closing phases.

For instance, assuming that the radial flow is established in each geological layer $C_n$ when the interface 24 starts to travel in the annular space 16 in the borehole portion 14 of the well 10, then the injectivity variation $\Delta q^{n,j}$ may be linked to the permeability $k_n$ of the geological layer $C_n$ by the following equation:

$$\Delta q^{n,j} = \frac{2\pi \times k_n \times e_n \times \Delta P^{n,j} \times f(\tau_n)}{\mu} = F(k_n, \Delta P^{n,j})$$

wherein:

- $\mu$ is the viscosity of the less viscous first fluid 22;
- $\Delta P^{n,j}$ is the pressure difference between, on one hand, the well pressure at the level of the geological layer $C_n$ during the well closing phase of index j and, on the other hand, the pressure $P_{geo}^{n}$ (a.k.a. "natural pressure") in the geological layer $C_n$ of the geological formation 30 (which does not depend on the well closing phase considered);
- $\tau_n = t/t_c$ is the reduced time for the geological layer $C_n$, wherein $t_c = r_w^2/K_n$, wherein $r_w$ is the radius of the well 10 in the borehole portion 14 and $K_n = k_n/(\mu \times \phi_n \times c_t)$, wherein $\phi_n$ is the porosity of the geological layer $C_n$ and $c_t$ is the total compressibility of the fluid in the pores, wherein $\phi_n$ and $c_t$ may be considered to be known a priori, for instance estimated or measured by other means; and
- $f(\tau_n)$ is a predetermined function which may for instance be expressed as follows if $\tau_n > 3$:

$$f(\tau_n) = \frac{2}{\ln(4\tau_n) - 2\gamma} - \frac{2\gamma}{[\ln(4\tau_n) - 2\gamma]^2}$$

wherein $\gamma$ is the number of Euler.

Of course, other equations and models may be used for different assumptions, and the present disclosure may also be used with different equations and models known to the skilled person.

It should be noted that, in the present example, the set of values $\{P_{geo}^{n}, 1 \le n \le N\}$ corresponds to the depth pressure profile of the geological formation 30, and the set of values $\{k_n, 1 \le n \le N\}$ corresponds to the depth permeability profile of the geological formation 30.

Also, the well pressure at the level of the geological layer $C_n$ during the well closing phase of index j, present in $\Delta P^{n,j}$, may be considered to be equal to the computed reference well pressure value $P_{well}^{n,j}$, such that $\Delta P^{n,j} \approx P_{well}^{n,j} - P_{geo}^{n}$. Hence, we may assume $\Delta q^{n,j} = F(k_n, P_{well}^{n,j} - P_{geo}^{n})$.

Accordingly, we have then, for each geological layer $C_n$, a non-linear system of two equations:

$$\begin{cases} \Delta q^{n,1} = F(k_n, P_{well}^{n,1} - P_{geo}^{n}) \\ \Delta q^{n,2} = F(k_n, P_{well}^{n,2} - P_{geo}^{n}) \end{cases}$$

wherein the permeability k n and the pressure $P_{geo}^{n}$ of the geological layer $C_n$ are the two only unknowns. Hence, this non-linear system of two equations may be solved, for each geological layer $C_n$, by using solving methods known to the skilled person, thereby obtaining the depth pressure and permeability profiles of the geological formation 30 in the borehole portion 14 of the well 10.

It is emphasized that the present disclosure is not limited to the above exemplary embodiments. Variants of the above exemplary embodiments are also within the scope of the present invention.

For instance, the present disclosure has been made while considering mainly two well closing phases. Of course, it is also possible to perform more than two well closing phases. For instance, it is possible to perform a third well closing phase under substantially the same conditions as for the first and second well closing phases, but maintaining a third constant pressure value in the annular space 16 at the first end 11 of the well 10, said third constant pressure value being preferably different from both the first and second constant pressure values, etc. Increasing the number of well closing phases considered, and the number of different constant pressure values, improves the accuracy of the estimated depth pressure and permeability profiles of the geological formation. Also, increasing the number of well closing phases considered, and the number of different constant pressure values, makes it possible to consider a higher number of unknowns. For instance, the porosity $\phi_n$ may be considered unknown and estimated by performing a third well closing phase, which yields a non-linear system of three equations and three unknowns.

The various embodiments described above can be combined to provide further embodiments. All of the patents and publications referred to in this specification and/or listed in the Application Data Sheet are incorporated herein by reference, in their entirety. Aspects of the embodiments can be modified, if necessary to employ concepts of the various patents and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. An estimating method for estimating a depth pressure and/or permeability profile of a geological formation, wherein a well extends in the geological formation between a first end and a second end, said method comprising:

equipping the well with an inner tube which extends between the first end of the well and towards the second end of the well, wherein said inner tube defines an inner space and an annular space in fluid communication towards the second end of the well, performing, when the annular space of the well is filled with a first fluid, a first well closing phase by injecting, into the inner space at the first end, a second fluid having a higher viscosity than the first fluid while extracting, from the annular space at the first end, the first fluid under a first constant pressure value in the annular space at the first end, wherein the first well closing phase comprises measuring a first temporal injection flowrate profile of the second fluid, a first temporal extraction flowrate profile of the first fluid, and a first temporal pressure profile in the inner space at the first end;

performing, when the annular space of the well is filled with the first fluid, a second well closing phase by injecting, into the inner space at the first end, the second fluid while extracting, from the annular space at the first end, the first fluid under a second constant pressure value in the annular space at the first end, wherein the second constant pressure value is different from the first constant pressure value, wherein the second well closing phase comprises measuring a second temporal injection flowrate profile of the second fluid, a second temporal extraction flowrate profile of the first fluid, and a second temporal pressure profile in the inner space at the first end; and estimating the depth pressure and/or permeability profile of the geological formation based on the measurements performed during the first well closing phase and the second well closing phase.

2. The estimating method according to claim 1, wherein; the geological formation is decomposed in a plurality of layers, and estimating the depth pressure and/or permeability profile comprises, for each of the first well closing phase and the second well closing phase:

determining a temporal evolution of a position in the well of an interface between the first fluid and the second fluid;

determining a variation of injectivity for each layer of the geological formation;

determining a temporal evolution of a pressure in the well along the layers of the geological formation;

determining a reference well pressure value for each layer of the geological formation based on the temporal evolution of the well pressure along the layers;

wherein a pressure value and/or a permeability value of the geological formation is determined for each layer of the geological formation, based on the variation of injectivity and on the reference well pressure value for each layer of the geological formation.

3. The estimating method according to claim 2, comprising solving a non-linear system of two equations for each layer of the geological formation.

4. The estimating method according to claim 1, wherein the first constant pressure value $P_1$ and the second constant pressure value $P_2$ are such that:

$$\max(P_1,P_2)/\min(P_1,P_2)>\alpha$$

wherein $\alpha$ is higher than or equal to 1.2.

5. The estimating method according to claim 1, wherein the first fluid has the same density as the second fluid.

6. The estimating method according to claim 1, wherein the second fluid is a gel and/or the first fluid is water or brine.

7. The estimating method according to claim 1, comprising performing at least a third well closing phase under a third constant pressure value in the annular space at the first end of the well, wherein said third constant pressure value is different from the first and second constant pressure values, wherein the depth pressure and/or permeability profile of the geological formation is estimated based on the measurements performed during the first, second, and third well closing phases.

8. A non-transitory computer-readable storage medium comprising code instructions which, when executed by a processor, cause said processor to carry out the estimating step according to claim 1, whereby the depth pressure and/or permeability profile of the geological formation is estimated based on the measurements performed during the first well closing phase and the second well closing phase.

9. System A system for estimating a depth pressure and/or permeability profile of a geological formation, wherein a well extends in the geological formation between a first end and a second end, said well is equipped with an inner tube which extends between the first end of the well and towards the second end of the well, and said tube defines an inner space and an annular space in fluid communication towards the second end of the well, wherein the system comprises:

means configured to perform, when the annular space of the well is filled with a first fluid, a first well closing phase by injecting, into the inner space at the first end, a second fluid having a higher viscosity than the first fluid while extracting, from the annular space at the first end, the first fluid under a first constant pressure value in the annular space at the first end, wherein the first well closing phase comprises measuring a first temporal injection flowrate profile of the second fluid, a first temporal extraction flowrate profile of the first fluid, and a first temporal pressure profile in the inner space at the first end;

means configured to perform, when the annular space of the well is filled with the first fluid, a second well closing phase by injecting, into the inner space at the first end, the second fluid while extracting, from the annular space at the first end, the first fluid under a second constant pressure value in the annular space at the first end, wherein the second constant pressure value is different from the first constant pressure value, wherein the second well closing phase comprises measuring a second temporal injection flowrate profile of the second fluid, a second temporal extraction flowrate profile of the first fluid, and a second temporal pressure profile in the inner space at the first end; and means configured to estimate the depth pressure and/or permeability profile of the geological formation based on the measurements performed during the first well closing phase and the second well closing phase.

10. The system according to claim 9, wherein the well comprises a cased portion at the first end and a borehole portion towards the second end.

11. The system according to claim 9, wherein the geological formation is decomposed in a plurality of layers, and the system is further configured to estimate the depth pressure and/or permeability profile by, for each of the first well closing phase and the second well closing phase:

determining a temporal evolution of a position in the well of an interface between the first fluid and the second fluid, determining a variation of injectivity for each layer of the geological formation, determining a temporal evolution of a pressure in the well along the layers of the geological formation, determining a reference well pressure value for each layer of the geological formation based on the temporal evolution of the well pressure along the layers, and wherein the system is configured to determine a pressure value and/or a permeability value of the geological formation for each layer of the geological formation, based on the variation of injectivity and on the reference well pressure value for each layer of the geological formation.

12. The system according to claim 11, further configured to solve a non-linear system of two equations for each layer of the geological formation.

13. The system according to claim 9, wherein the first constant pressure value $P_1$ and the second constant pressure value $P_2$ are such that:

$$\max(P_1,P_2)/\min(P_1,P_2)>\alpha$$

wherein $\alpha$ is higher than or equal to 1.2.

14. The system according to claim 9, wherein the first fluid has the same density as the second fluid.

15. The system according to claim 9, wherein the second fluid is a gel and/or the first fluid is water or brine.

16. The system according to claim 9, further configured to perform at least a third well closing phase under a third constant pressure value in the annular space at the first end of the well, wherein said third constant pressure value is different from the first and second constant pressure values, wherein the depth pressure and/or permeability profile of the geological formation is estimated based on the measurements performed during the first, second, and third well closing phases.

* * * * *